US006246379B1

(12) United States Patent
Josypenko

(10) Patent No.: US 6,246,379 B1
(45) Date of Patent: Jun. 12, 2001

(54) HELIX ANTENNA

(75) Inventor: Michael J. Josypenko, Norwich, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/356,803

(22) Filed: Jul. 19, 1999

(51) Int. Cl.[7] ..... H01Q 1/36

(52) U.S. Cl. ..... 343/895; 343/850; 343/853; 343/859

(58) Field of Search ..... 343/700 MS, 850, 343/859, 853, 725, 895; H01Q 1/36

(56) References Cited

U.S. PATENT DOCUMENTS 3,702,481 * 11/1972 Koller et al. ..... 343/844
5,572,172 * 11/1996 Standke et al. ..... 333/128
5,793,338 * 8/1998 Standke et al. ..... 343/895
5,828,348 * 10/1998 Tassoudji et al. ..... 343/895
5,838,285 * 11/1998 Tay et al. ..... 343/895
6,011,524 * 1/2000 Jervis ..... 343/895

* cited by examiner

*Primary Examiner*—Hoanganh Le
*Assistant Examiner*—Shih-Chao Chen
(74) *Attorney, Agent, or Firm*—Michael J. McGowan; Robert W. Gauthier; Prithvi C. Lall

(57) ABSTRACT

A helix antenna includes a base portion for containing a feed network including a power input, a 90 degree power splitter in communication with the power inlet, and first and second 180 degree power splitters in communication with the 90 degree power splitter. A support tube is mounted on the base portion, and a plurality of disk separators are mounted on the tube. Four elongated elements are wound around the tube and are spaced therefrom by the disk separators. The elements are connected to end-most lower and upper ones of the disk separators, the elements extending toward a center feed point of the upper disk separator. First and second radially opposite pairs of feed cables are wound around the support tube, extending from the lower disk separator to the upper disk separator, and are in communication, respectively, with the first and second 180 degree power splitters.

21 Claims, 8 Drawing Sheets

Frequency (MHz): 280

HELIX ANTENNA

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to a quadrifilar helix antenna and is directed more particularly to such an antenna for use in satellite communications and for disposition on seagoing surface vessels.

(2) Description of the Prior Art

The antenna currently used onboard ship in satellite communications bands (about 240 MHz to 410 MHz) is a mechanically steered reflector backed dipole assembly which, because of its weight, must be mounted on deck.

There exists a need for a simple, rugged, relatively small and lightweight antenna which can be mounted on the mast of a surface vessel and be proficient in wideband satellite communications, including Demand Assigned Multiple Access (DAMA) UHF satellite communications functions in the range of 240–320 MHz, and for other satellite communications functions in the range of 320–410 MHz.

SUMMARY OF THE INVENTION

It is, therefore, an object of the invention to provide a relatively small, lightweight, antenna assembly capable of operation in the satellite communications band range of 240–410 MHz, and suitable for mounting on a ship's mast.

A further object of the invention is to provide such an antenna assembly as is strong, rugged, and relatively simple to construct.

A still further object of the invention is to provide such an antenna requiring no external components, such as matching networks, that require placement at critical locations on the antenna and that have to be protected.

With the above and other objects in view, as will hereinafter appear, a feature of the present invention is the provision of a helix antenna comprising a base portion for containing a phase quadrature feed network including a power input, a 90 degree power splitter in communication with the power input, and first and second 180 degree power splitters in communication with the 90 degree power splitter. A support tube is mounted on the base portion, and a plurality of disk separators are mounted on the tube and are spaced from each other and extend radially outwardly from the tube. Four elongated elements are wound around the support tube and are spaced therefrom by the disk separators, the elements being connected to end-most lower and upper ones of the disk separators, the elements extending toward a center feed point of the upper disk separator and comprising radial feed arm portions of the four elements. First and second radially opposite pairs of feed cables are wound about the support tube, attached to the inside middles of the elements and extend from the lower disk separator to the upper disk separator, and are in communication, respectively, with the first and second 180 degree power splitters.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of the invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters refer to corresponding parts throughout the several views of the drawings and wherein.

DESCRIPTION OF THE PREFERRED EMBODIMENT

Figure 1:
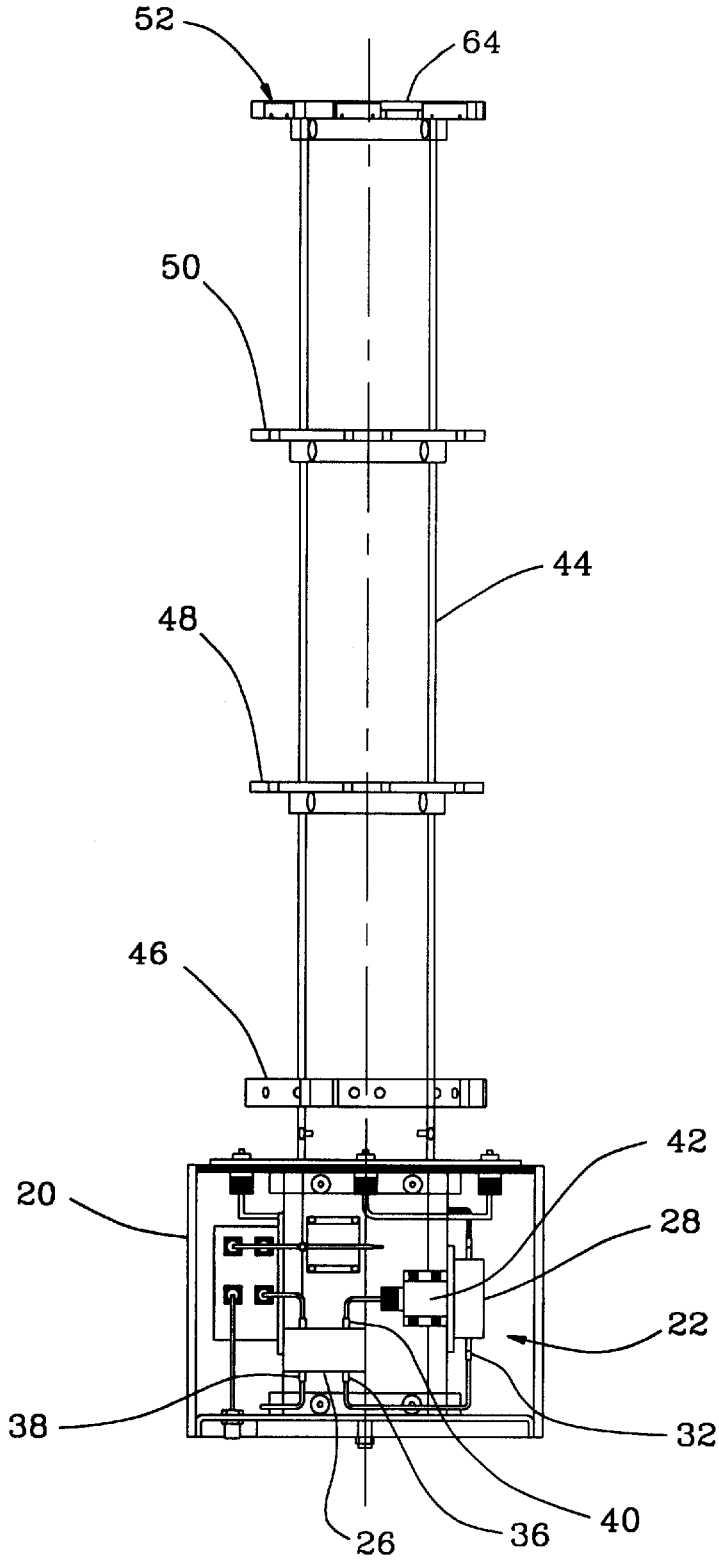
FIG. 1 is a side elevational view, in part broken away, of housing, base portion, support tube, and disk separator components of an antenna assembly illustrative of an embodiment of the invention.
Figure 5:
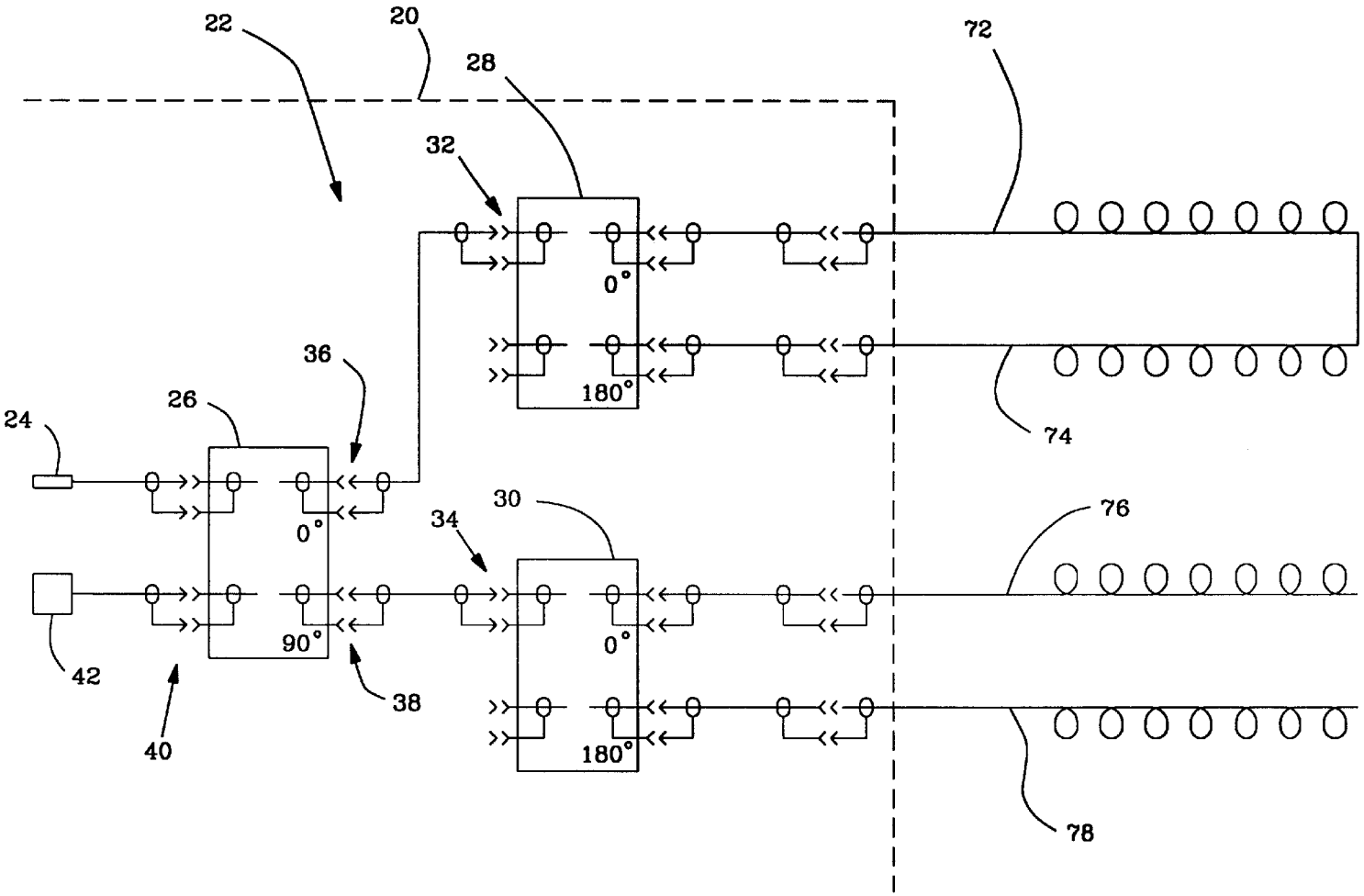
FIG. 5 is a schematic diagram of the feed network and feed cables of the antenna assembly.

Referring to FIG. 1 and also to FIG. 5, it will be seen that an illustrative embodiment of the invention includes a base portion 20 for containing a phase quadrature feed network 22, including a power input 24 (FIG. 5), a 90 degree power splitter 26 in electrical communication with the power input 24, and first and second 180 degree power splitters 28, 30 (FIG. 5).

Input ports 32, 34 (FIG. 5) of the 180 degree power splitters 28, 30, respectively, are connected to 0 and 90 degree output ports 36, 38 of the 90 degree power splitter 26. A dump port 40 of 90 degree power splitter 26 is terminated in a 50 ohm termination 42 which is adapted to handle any mismatch of the antenna.

A support tube 44 is mounted on base portion 20 and extends therefrom. The support tube 44 preferably is of fiberglass with a wall thickness of about ¼ inch.

A plurality of disk separators 46, 48, 50 and 52 are mounted on support tube 44 and are spaced from each other by substantially equal intervals. The disk separators 46, 48, 50, 52 extend radially outwardly from support tube 44. Disk separators 46, 48, 50, 52 preferably are about 9 inches in diameter. The disk separators 48, 50, 52 are of fiberglass, or the like. The disk separator 46 is of metal, provided for purposes of shorting elements, to be described hereinbelow.

Figure 2:
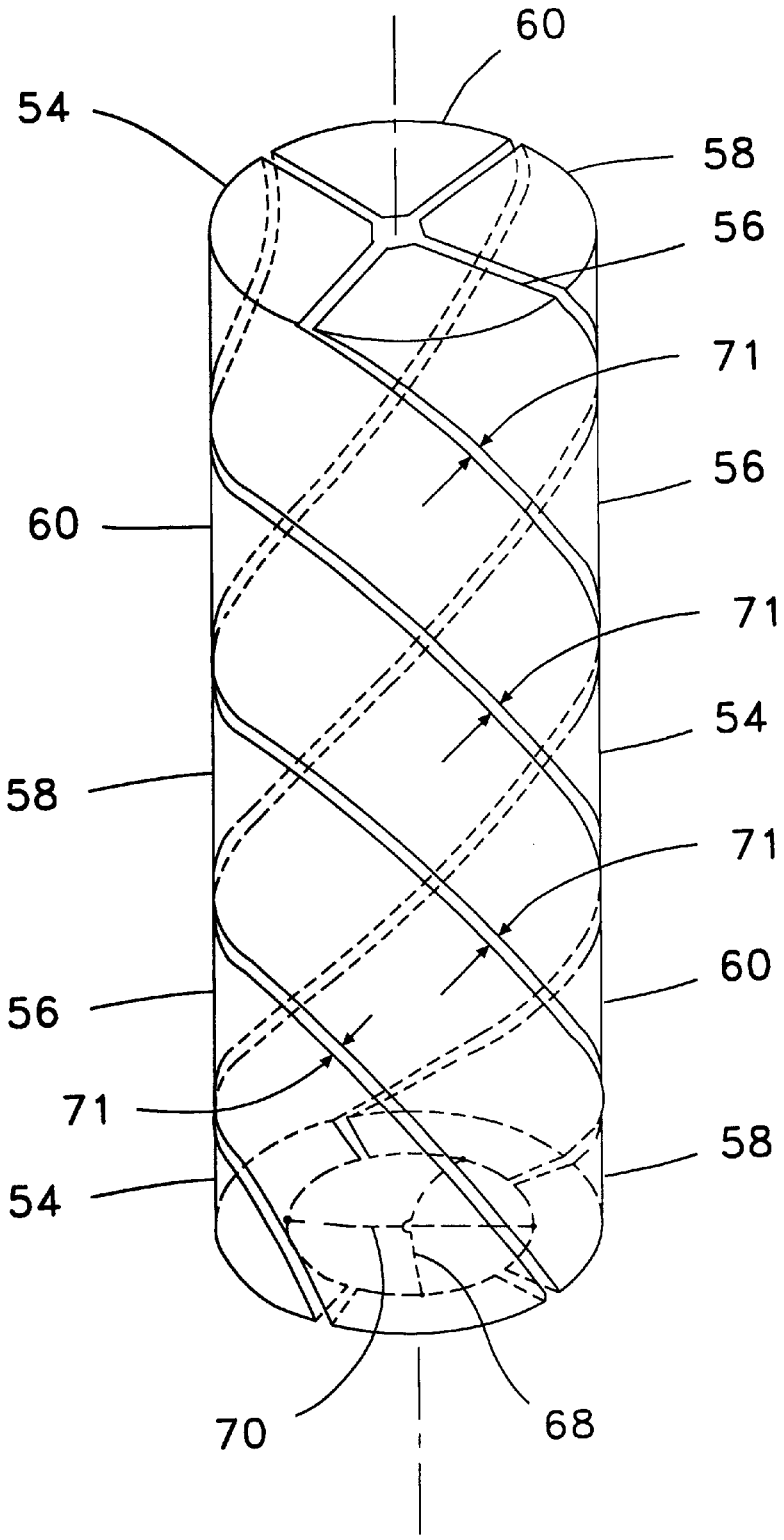
FIG. 2 is a perspective view of four elongated elements for disposition in combination with the components of FIG. 1.
Figure 3:
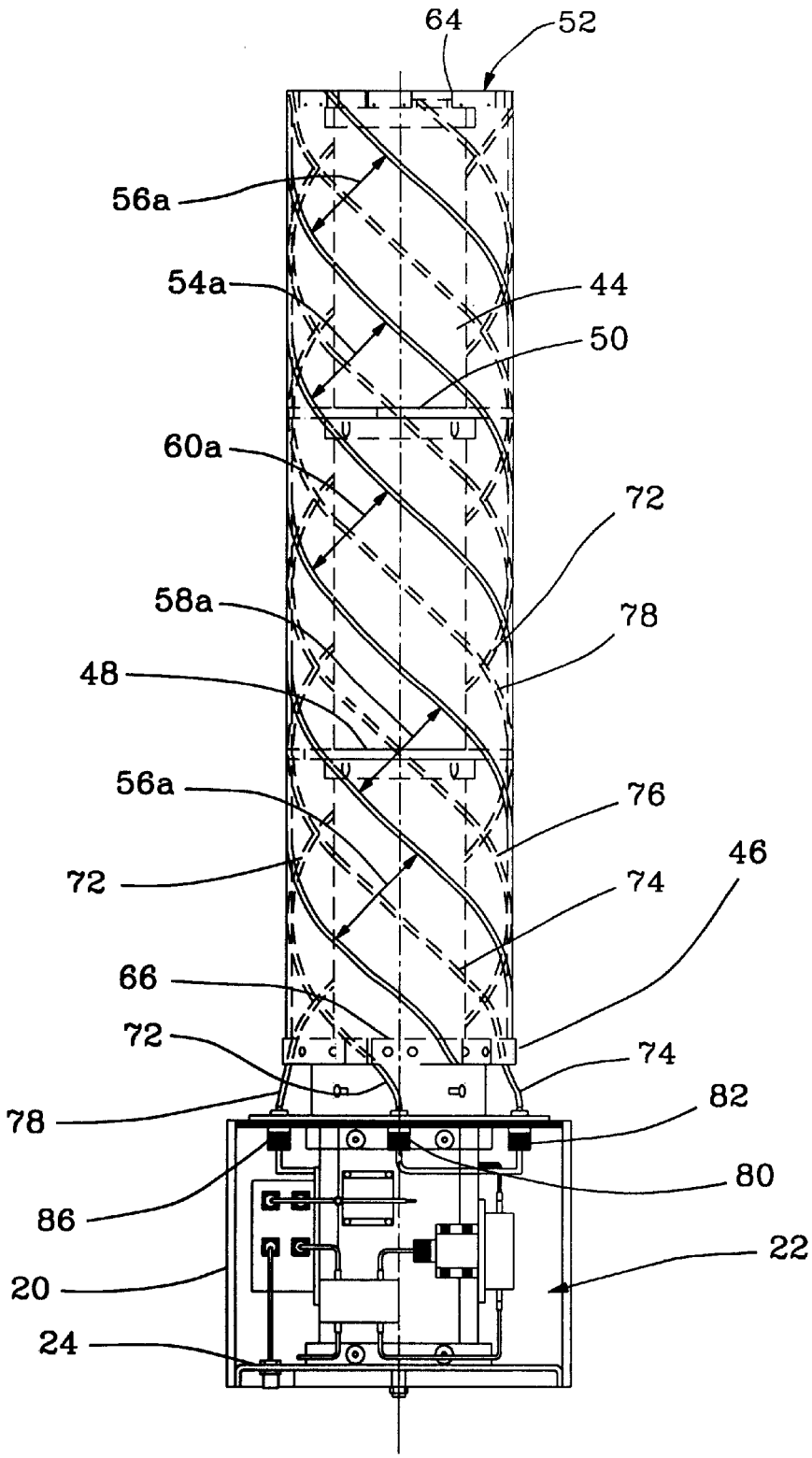
FIG. 3 is a side elevational view, in part broken away, of the components of FIG. 1 in combination with the components of FIG. 2, and further in combination with feed cables.
Figure 4:
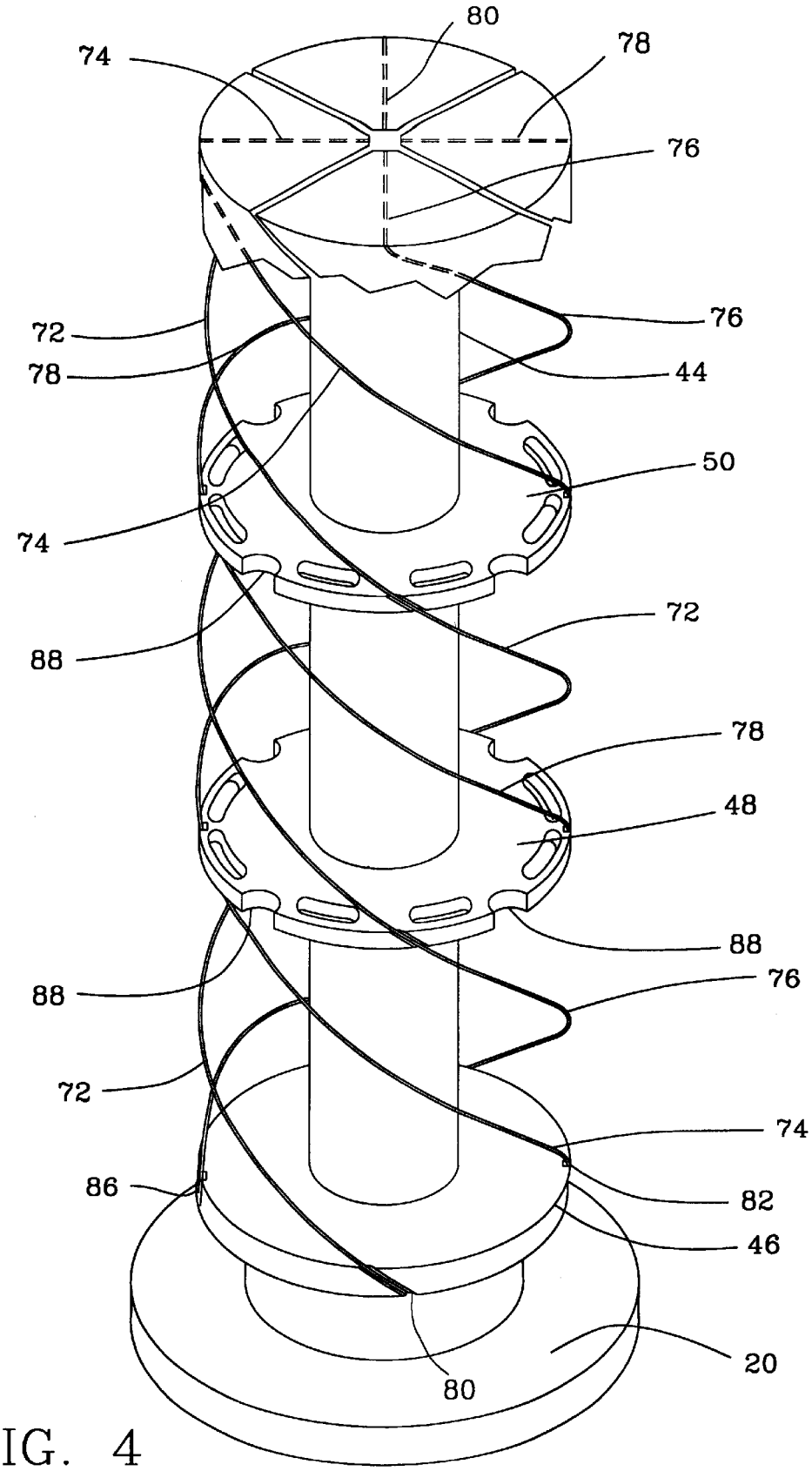
FIG. 4 is a perspective view of the antenna assembly of FIG. 3.

Referring now to FIGS. 2–4, four elongated elements 54, 56, 58, 60 (FIGS. 2–4) are wound around support tube 44 and are spaced therefrom by disk separators 46, 48, 50, 52.

Figure 6:
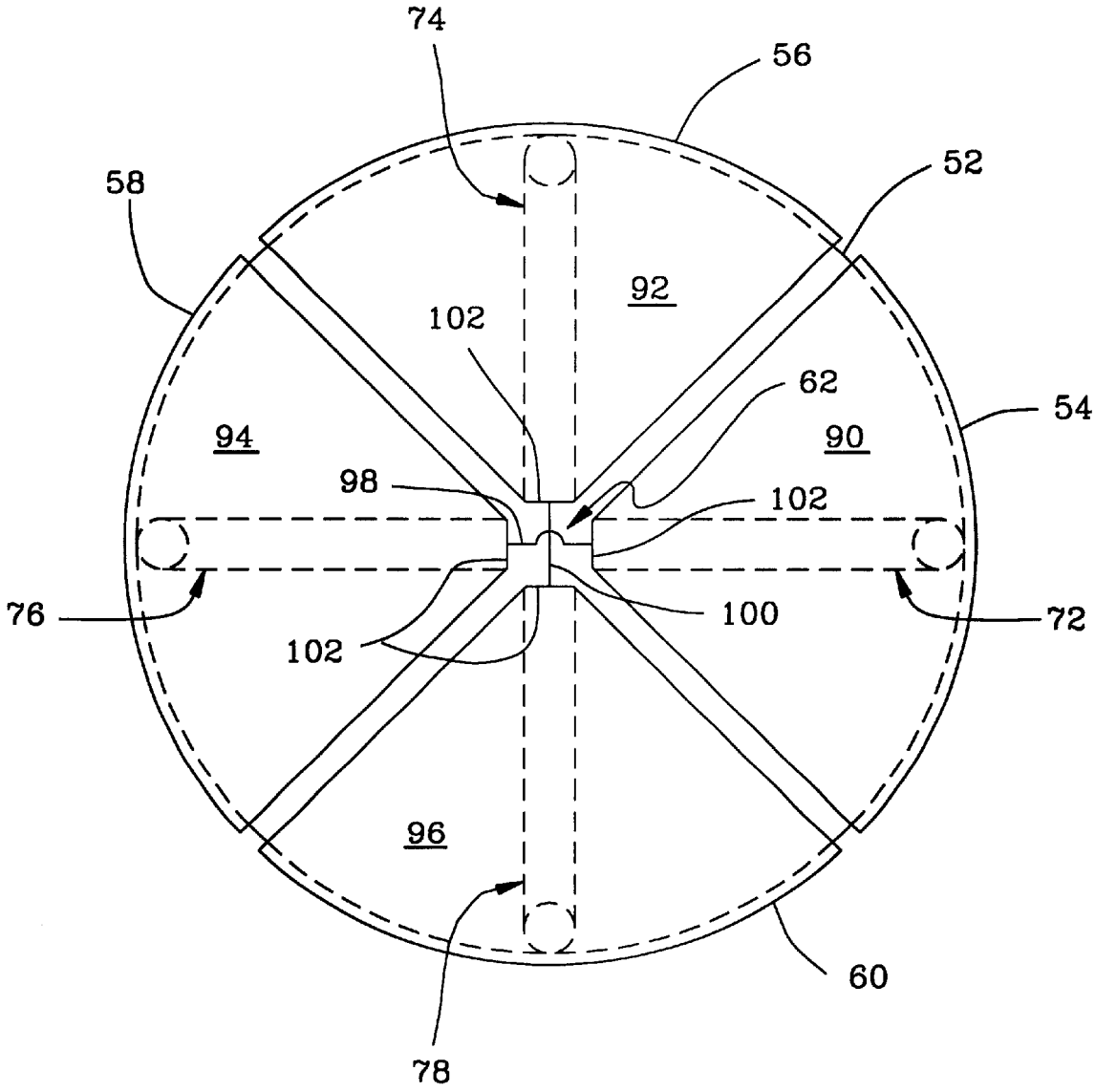
FIG. 6 is a diagrammatic top plan view of the antenna assembly.

In FIG. 3, the span of the elements 54–60 are shown as 54*a*–60*a*, respectively. The elements 54, 56, 58, 60 are connected to the lower and upper end-most disks 46, 52. The elements 54, 56, 58 and 60 extend radially inwardly toward a center feed point 62 on a top surface 64 of the upper end disk 52 (FIGS. 2 and 6). The physical and r.f. separation between adjacent elements is 90 degrees. The angle at which an element starts a wrap around tube 44 is the pitch angle 66 (FIG. 3). The elements 54, 56, 58, 60 are fed from the center feed point 62 at the upper end of the antenna. The upper ends of the elements 54, 56, 58, 60 are extended radially inwardly (FIGS. 2, 4, 6). By feeding the four elements 54, 56, 58, 60 at center feed point 62 in phase quadrature, a cardoid shaped pattern can be radiated either from the feed end 52 of the antenna (backfire mode) or from the opposite end 46 of the antenna (forward fire mode). Less backside radiation occurs when the antenna is fed in "backfire" mode, as opposed to "forward fire" mode. Thus, it is preferable that the antenna be fed at its top 52. At the lower end of the antenna, the elements 54, 56, 58, 60 are continued by extending radially towards the center of the lower end disk 46. The elements can be connected by shorts 68, 70 (FIG. 2). If so connected, the antenna is referred to as being "shorted". Without the shorts 68, 70, the antenna is referred to as being "open". Alternatively, the elements at the lower end may be connected together by being bolted to separator disk 46, which is of metal, and which serves as a radial short. The effect of the shorts appears to be minimal.

Figure 7:
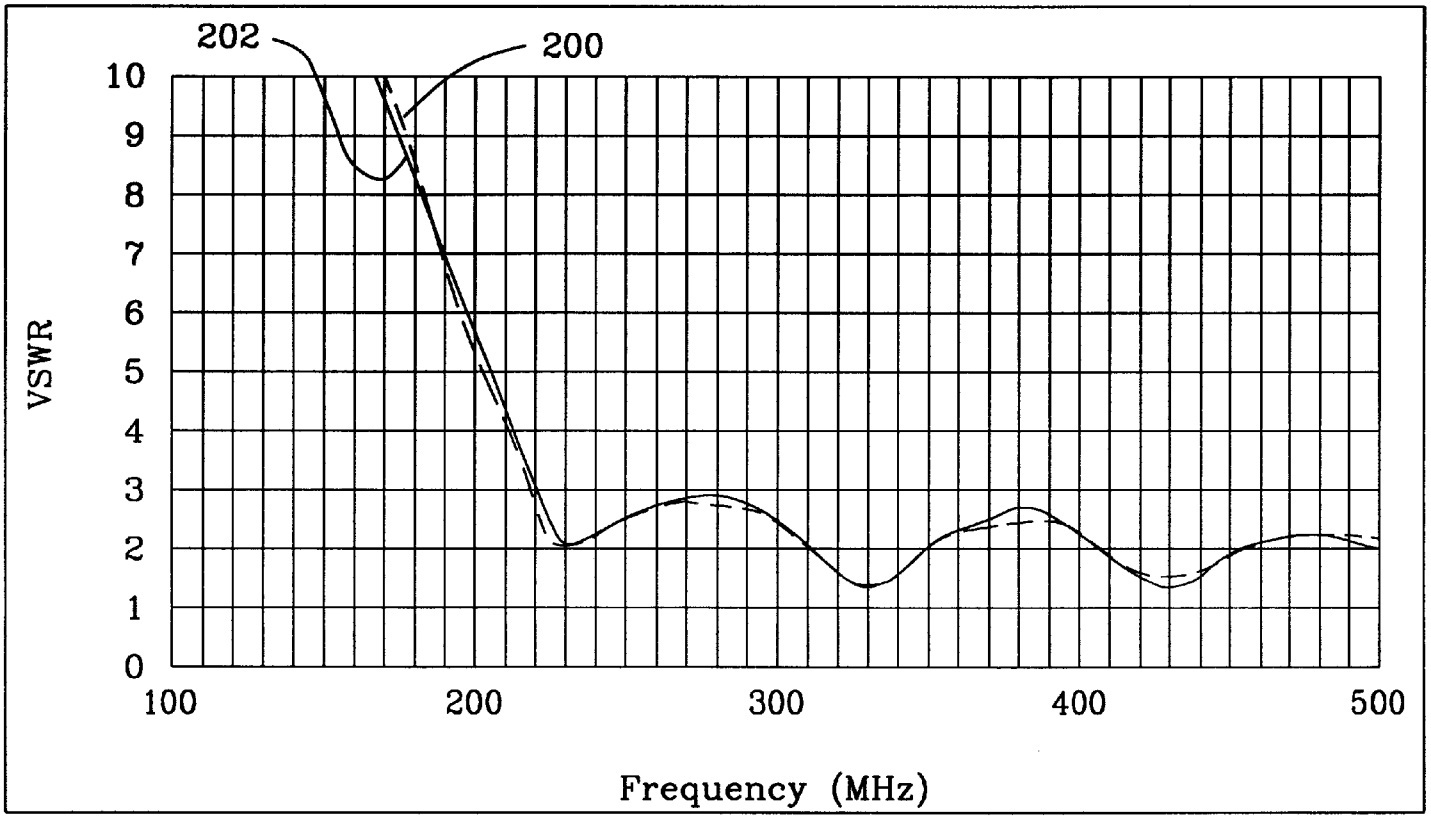
FIG. 7 is a VSWR vs. frequency plot for the antenna.

The elements 54, 56, 58, 60 may be of metal wire, metal tube, or metal strip. The diameter or width of the element and its pitch angle 66 determine the characteristic impedance Zo of the antenna. With a long enough element, the diameter also determines the "cut in" frequency of the antenna, i.e., the frequency above which the antenna has a low VSWR, broadband impedance match. In this case, one turn of an element must be roughly ½ wavelength in length at "cut in". The minimum length of an element is about ¾ wavelength to provide a "cut in" frequency at 200 Mhz (FIG. 7 where opposite pairs of feed cables are shown by lines 200 and 202). Shown in the drawings are metal strip type elements 54, 56, 58, 60, shown as transparent (FIG. 3) and partially (FIG. 4) for illustrative purposes, so as to show the interior of the antenna which, in reality, is obscured by the metal strip elements. A preferred width of each metal strip element and its pitch angle preferably is selected for an antenna characteristic impedance of 100 ohms, so as to match the 100 ohm input impedance of the feed of 180° degree power splitters 28, 30 and thus require no matching circuits.

The cylinder formed by the end disks 46, 52 and elements 54, 56, 58, 60 preferably is about 39.25 inches long and about 9 inches in diameter. The metal strip elements preferably are of copper and are of a width of about 4.5 inches and a thickness of 1/16–1/8 inch. The preferred pitch angle 66 is 42.5°. A gap 71 (FIGS. 2–4) between metal strip elements is about 0.2388 inch for ⅛ inch thick elements and less for 1/16 inch elements, maintaining the 100 ohm impedance of the antenna.

The antenna further includes first and second radially opposite pairs of feed cables 72, 76; 74, 78 (FIGS. 3 and 4). The feed cables are in electrical communication with the 180° power splitters 28, 30 (FIG. 5). The cables preferably are simirigid 50 ohm cables and are of 0.141 inch diameter. The cables are introduced at points 80, 82, 84, 86 (FIGS. 3 and 4; point 84 is hidden in these views but is opposite point 80 between points 82 and 86), pass through the lower end disk separator 46, mounted on the inside centers of elements 54, 56, 58, 60, and spiral around the support tube 44. The feed cables 72, 74, 76, 78 are thus protected physically by the metal strip elements 54, 56, 58, 60.

The disk separators 46, 48, 50, 52 keep tube 44 a reasonable distance from elements 54, 56, 58, 60 to prevent tube 44 from dielectrically loading the elements. Loading the elements is undesirable as it produces more backside radiation. Notches 88 (FIG. 4) are provided on the perimeters of disk separators 46, 48, 50, 52 where the gaps 71 between elements 54, 56, 58, 60 cross the disks, to prevent the disks from dielectrically loading the gap regions of the elements, where the fields are dense.

The elements 54, 56, 58, 60 are fed from the center feed point 62 at the top end. The upper ends of the elements are truncated (FIGS. 2–4, 6) and extend inwardly toward the center feed point 62 to serve as radial feed arms 90, 92, 94, 96. The feed cables 72, 74, 76, 78 are directed radially inwardly by the feed arms 90, 92, 94, 96. Feed cables 72, 76 at their upper ends are interconnected by a center conductor 98, and feed cables 74, 78 are connected together by a center conductor 100 (FIG. 6). The center conductors 98, 100 are insulated. The ends of the feed cables 72, 74, 76, 78 outer conductors 102 (FIG. 6), are connected to their respective elements 90, 92, 94, 96 to serve as the feed points for the elements. The ends of feed cables 72, 74, 76, 78 and the center conductors 98, 100 are covered with a plastic material (not shown) to protect the cables and conductors from the environment. In addition, a topcap (not shown) of fiberglass, or the like, may be placed on the upper end of the antenna to prevent foreign material from contaminating the feed region. The feed cables 72, 74, 76, 78 being introduced at the shorted bottom end 46 of the antenna, spiraling up elements 54, 56, 58, 60 and across the upper end arrangement facilitates the use of the entire antenna as an infinite balun.

In operation, the 180 degree power splitters 28, 30 provide 180 degree phase difference between two radial opposite elements (72, 74;76, 78), and also match the 100 ohm impedance between the feed arms to the 50 ohm input impedance of the splitters. The two inputs of the splitters are fed with the 0° and 90° output ports 36, 38 of 90° splitter 26, resulting in a quadrature feed phase for elements 54, 56, 58, 60, i.e., adjacent elements are 90° out of phase with each other.

The RF height of the antenna can be reduced by introducing, physical shorts (not shown) across the gaps 71 between the elements at the base of the helix and moving them up along the gaps for 2–8 inches. By adjusting the RF height the sharpness of the patterns can be adjusted so as to favor either the DAMA transmit or receive bands. For example, reducing the height sharpens the patterns, that is, makes the patterns more pointed overhead, thus reducing pattern flattening at higher frequencies. This helps reduce loss of gain in overhead flattening in the transmit band and reduces gain near the horizon in the receive band.

There is thus provided a small, lightweight antenna that is rugged and simple to construct, and suitable for mounting on a surface ship mast. There are no external RF components, such as matching networks, required to be placed at critical locations on the antenna.

Figure 8:
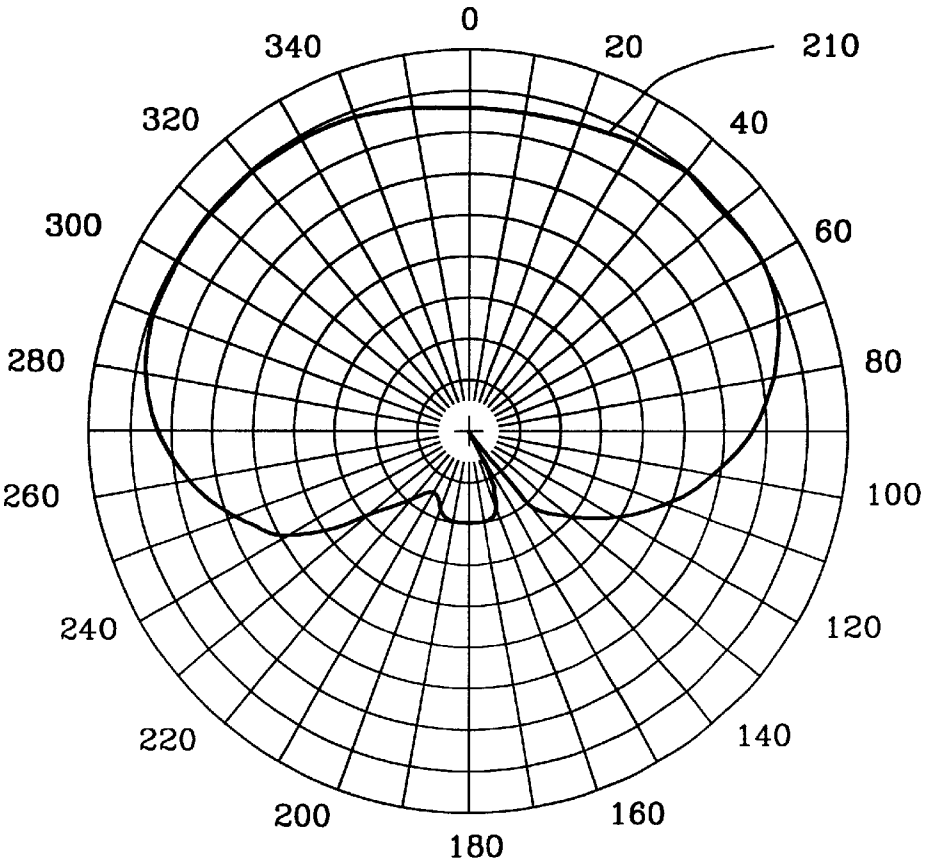
FIG. 8 is a representative pattern of the antenna at 280 MHz.

There is further provided such an antenna exhibiting patterns and impedances (VSWR of about 2:1) suitable for DAMA and other satellite communications, in a band range of 240–410 Mhz. FIG. 8 shows a representative pattern (line 210) of the antenna at 280 MHz.

It will be understood that many additional changes in the details, materials, and arrangements of parts, which have been herein described and illustrated in order to explain the nature of the invention, may be made by those skilled in the art within the principles and scope of the invention as expressed in the appended claims.

What is claimed is:

1. A helix antenna comprising:

a power input;

a 90 degree power splitter in electrical communication with said power input;

first and second 180 degree power splitters in communication with said 90 degree power splitter;

said power input, said 90 degree power splitter, and said first and second 180 degree power splitters forming a phase quadrature feed network for said antenna;

a support tube of dielectric material;

a plurality of disk separators of dielectric material mounted on and supported by said tube and spaced from each other and extending radially outwardly from said tube;

four elongated elements wound around said support tube and spaced therefrom by said disk separators, said elements being supported by said disk separators, said elements extending toward a center feed point of an upper of said disk separators and comprising radial feed arm portions of said four elements; and first and second radially opposite pairs of feed cables wound around said support tube, extending from a lower of said disk separators to the upper disk separator and in communication, respectively, with said first and second 180 degree power splitters.

2. The helix antenna in accordance with claim 1 wherein said feed network further includes a 50 ohm termination in electrical communication with said 90 degree power splitter.

3. The helix antenna in accordance with claim 1 wherein said support tube is of fiberglass and is provided with a wall thickness of about ¼ inch, and is about 39.25 inches in length.

4. The helix antenna in accordance with claim 1 wherein said elongated elements are of metal.

5. The helix antenna in accordance with claim 4 wherein said elongated elements are a selected one of wire, tubing, and strip.

6. The helix antenna in accordance with claim 5 wherein said elongated elements are copper strips having a width and a pitch angle selected to provide an antenna impedance of 100 ohms.

7. The helix antenna in accordance with claim 6 wherein said elongated elements are each separated from adjacent elongated elements by an air gap of about 0.24 inch, are about ⅛ inch thick, of a width of about 4.5 inches, and are disposed at a pitch angle of about 42.50°.

8. The helix antenna in accordance with claim 6 wherein said elongated elements are each separated from adjacent elongated elements by an air gap of less than 0.24 inch, are about 1/16 inch thick, of a width of about 4.5 inches, and are disposed at a pitch angle of about 42.50°.

9. The helix antenna in accordance with claim 6 wherein said elongated elements are extended radially inwardly of said lower disk separator toward the center of said lower disk separator.

10. The helix antenna in accordance with claim 9 wherein said radially inwardly extended elements include a first pair of said elements connected to each other and a second pair of said elements connected to each other.

11. The helix antenna in accordance with claim 9 wherein said elements are fixed to said lower disk separator and said lower disk separator is of metal.

12. The helix antenna in accordance with claim 6 wherein each of said elongated elements is provided with a length of at least about ¾ wavelength at a cut in frequency of 200 MHz.

13. The helix antenna in accordance with claim 6 wherein said disk separators are about nine inches in diameter, said diameter resulting in one winding of said elongated elements about said tube having a length of about ½ wavelength at a cut in frequency of 200 MHz.

14. The helix antenna in accordance with claim 7 wherein said disk separators are provided with peripheral notches and said air gaps are disposed in radial alignment with said notches.

15. The helix antenna in accordance with claim 8 wherein said disk separators are provided with peripheral notches and said air gaps are disposed in radial alignment with said notches.

16. The helix antenna in accordance with claim 6 wherein said feed cables are each mounted on one of said elongated elements and centrally thereof.

17. The helix antenna in accordance with claim 16 wherein said feed cables are fixed to interior surfaces of said elongated elements.

18. The helix antenna in accordance with claim 16 wherein first and second opposite ones of said feed cables are interconnected on said upper disk separator by a first center conductor, and third and fourth opposite ones of said feed cables are interconnected on said upper disk separator by a second center conductor.

19. The helix antenna in accordance with claim 1 wherein said lower disk separator is of metal and the remaining disk separators are of dielectric material.

20. The helix antenna in accordance with claim 1 wherein said antenna further comprises a base portion containing said phase quadrature feed network and on which said support tube is mounted.

21. The helix antenna in accordance with claim 16 wherein each of said feed cables is provided with an outer conductor connected to its respective one of said elongated elements.

* * * * *